US005107542A

United States Patent [19]

Zide et al.

[11] Patent Number: 5,107,542

[45] Date of Patent: Apr. 28, 1992

[54] FRONT-LOCK STABILIZER FOR PROTECTIVE SHOULDER PADS

[76] Inventors: Robert M. Zide, 300 W. Fourth St., Williamstown, W. Va. 26187; James L. Rector, 1709 Forest Hill Dr., Vienna, WV, Va. 26105

[21] Appl. No.: 672,882

[22] Filed: Mar. 21, 1991

[51] Int. Cl.[5] ..... A41D 13/00

[52] U.S. Cl. ..... 2/2; 2/44

[58] Field of Search ..... 2/2, 44, 45, 267, 668, 2/92, 96; 450/141; 36/50, 53

[56] References Cited

U.S. PATENT DOCUMENTS

| | | | |
|---|---|---|---|
| 1,640,042 | 8/1927 | Latina | 2/2 |
| 2,545,039 | 3/1951 | Mitchell | 2/2 |
| 3,087,163 | 4/1963 | Kelly | 2/2 |
| 3,158,871 | 12/1964 | Morgan | 2/2 |
| 3,509,579 | 5/1970 | Morgan | 2/2 |
| 3,514,784 | 6/1970 | McDavid | 2/2 |
| 3,528,106 | 4/1969 | Austin | 2/2 |
| 3,740,762 | 6/1973 | Truelove | 2/2 |
| 3,981,027 | 9/1976 | Anderson | 2/2 |
| 4,158,242 | 6/1979 | Mitchell | 2/2 |
| 4,295,227 | 10/1981 | Mitchell | 2/2 |

*Primary Examiner*—Werner H. Schroeder
*Assistant Examiner*—Amy Brooke Vanatta
*Attorney, Agent, or Firm*—Brady, O'Boyle & Gates

[57] ABSTRACT

A front-lock stabilizer for protective shoulder pads having breastplates and backplates wherein the breastplates are closed by laced interdigitated plates fixedly secured to the vertical edges of the breastplates, and the backplates are closed by a plurality of rigid plates extending between the backplates and fixedly secured thereto. The breastplates are prevented from being deflected inwardly relative to each other to thereby prevent injury to the wearer's sternum, and the right and left shoulder pads are prevented from movement relative to each other in a vertical plane to prevent one shoulder from receiving the full impact of a hit to the shoulder.

10 Claims, 3 Drawing Sheets

FRONT-LOCK STABILIZER FOR PROTECTIVE SHOULDER PADS

BACKGROUND OF THE INVENTION

This invention relates to shoulder pads for football players of the type disclosed in U.S. Pat. Nos. 4,158,242, dated Jun. 19, 1979, and 4,295,227, dated Oct. 20, 1981, wherein a pair of inverted plastic arch members having resilient padding attached to the underside thereof are worn over the shoulders of the player wherein the base portion of each arch member is supported on a respective shoulder of the player, and the legs of each arch member extend over the front and back of the player to provide a chest plate portion and a backplate portion, respectively, covering the upper chest and upper back of the player. The chest plate portions of the shoulder pads are laced together while the backplate portions are connected by a parallelogram linkage, whereby the individual arch members are allowed to move slightly with respect to each other to provide freedom of movement and comfort to the player.

SUMMARY OF THE INVENTION

While the shoulder pads of the prior art of the type disclosed in the above-mentioned patents have been satisfactory for their intended purpose, the construction and arrangement of the pads to provide comfort and freedom of movement for the player resulted in a concomitant problem in that the lacing acts as a hinge so that if a player is hit in the sternum area of the chest the chest plates are deflected inwardly against the sternum resulting in injury to the player. Furthermore, if a player is hit on top of the left or right shoulder, the lacing connecting the breastplate portions and the parallelogram linkage connecting the backplate portions allows the arch members to move relative to each other in a vertical plane resulting in the particular shoulder taking the full impact of the hit causing injury thereto.

After considerable research and experimentation, the stabilizer system of the present invention has been devised to prevent injury to the player's sternum and shoulders by the relative movement of the arches and breastplates, and comprises essentially, a laced closure on the chest plates wherein a pair of spaced, rigid, plastic plates are riveted to the edge portion of a breastplate on one arch member, and a single rigid, plastic plate is riveted to the corresponding edge portion of the other arch member. The single plate is interleaved with the pair of plates, and a pair of laces extends through an arrangement of plural aligned apertures in the interdigitated plates to thereby connect the three plates, whereby the breastplate portions are prevented from moving relative to each other inwardly against the player's sternum. The free vertical edge portion of one of the interdigitated plates on each of the breastplates of the respective arch members, abuts the vertical edge portion of the breastplate on the opposite respective arch member, while the edge portions of the backplates are held in rigid spaced relationship by a plurality of rigid, plastic plates extending between the backplate portions and riveted thereto, whereby the arch members are prevented from movement relative to each other in a vertical plane. By this construction and arrangement, injury to the player's sternum and shoulders are prevented or at least minimized.

DESCRIPTION OF THE PREFERRED EMBODIMENT

Figure 1:
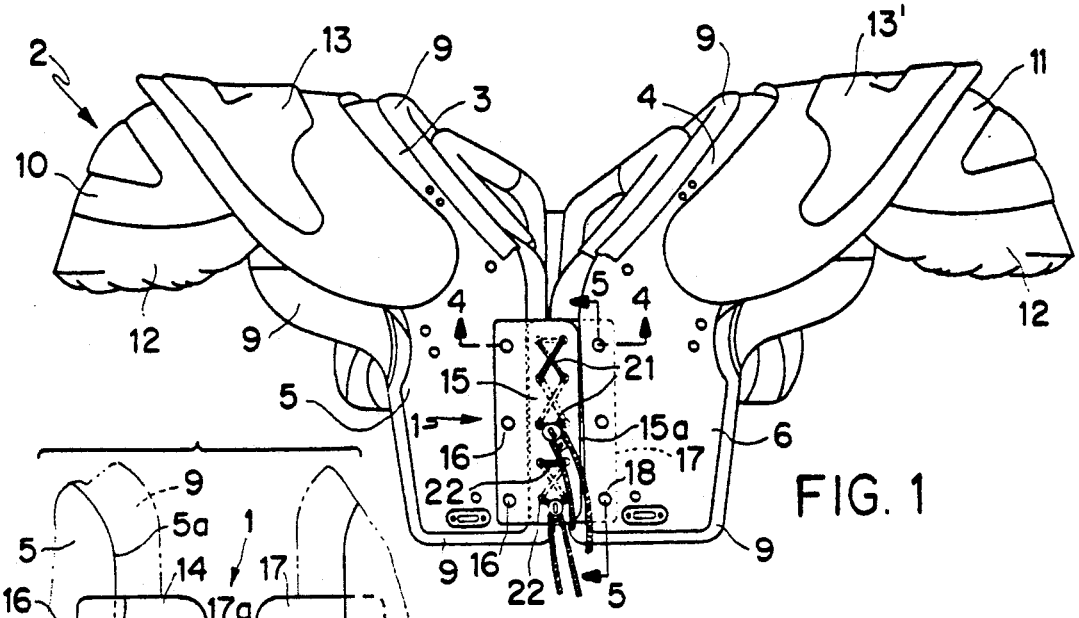
FIG. 1 is a front elevational view of a pair of shoulder pads employing the front-lock stabilizer of the present invention.
Figure 3:
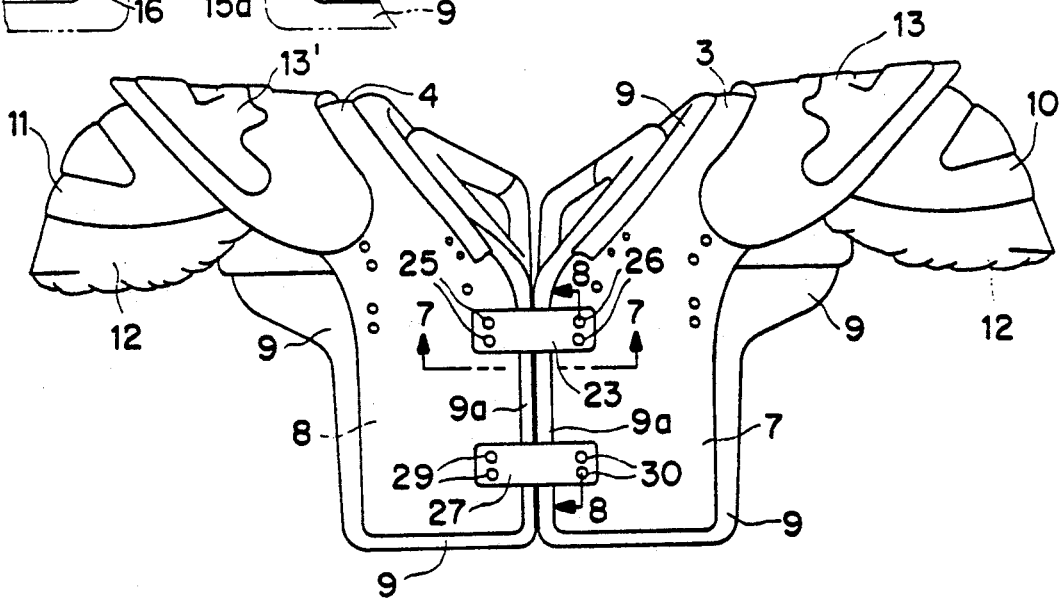
FIG. 3 is a rear elevational view of the shoulder pads illustrated in FIG. 1, showing the fixed plates connecting the backplates of the pads together.

Referring to the drawings, and more particularly to FIGS. 1 and 3, the front-lock stabilizer 1 of the present invention is adapted to be employed in conventional shoulder pads 2 worn by football players wherein the pads include a pair of hard plastic inverted arch members 3, 4 having depending leg portions 5 and 6 on the front of the pads to form a breastplate portion, and depending leg portions 7 and 8 on the rear of the pads, FIG. 3, to form a backplate portion. Resilient padding 9 is attached by conventional means, such as rivets or the like, to the underside of the arch members 3 and leg portions 5, 6, 7, and 8. Caps 10 and 11 having padding 12 are connected to the arch members 3 and 4, as are rigid flaps 13 and 13', which overlie the caps 10 and 11.

Figure 2:
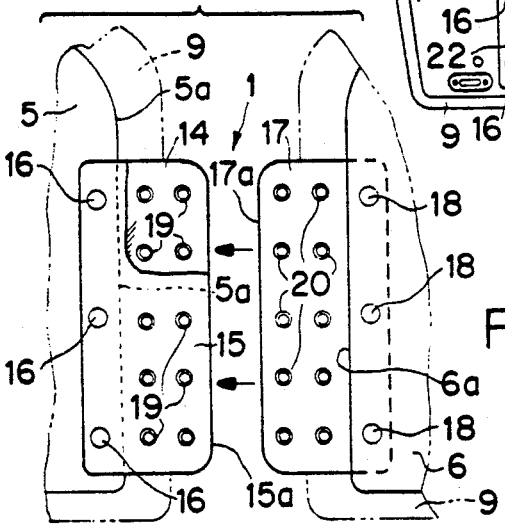
FIG. 2 is a fragmentary, front elevational view, on an enlarged scale, and partly broken away, showing the plates of the closure being moved into interdigitated relationship.

As will be seen in FIGS. 1 and 2, the front-lock stabilizer 1 of the present invention comprises a pair of spaced, rigid, plastic plates 14 and 15 riveted as at 16 to the edge portion of the back and front of the chest plate leg 5, and a single rigid, plastic plate 17 riveted as at 18 to the corresponding edge portion of the back of chest plate leg 6. The plate 17 is interleaved with the pair of plates 14 and 15, and the plates are provided with a plurality of holes in an array, as eyelets 19 and 20, which become aligned when the plates 14, 15 and 17 become interdigitated, through which a pair of laces 21 and 22 are threaded to hold the plates 14, 15 and 17 together, whereby the breastplate portions 5 and 6 are prevented from moving relative to each other inwardly against the player's sternum to thereby prevent injury thereto. Sliding releasable clasps of a conventional type are provided on the laces 21 and 22 to retain them in tightly laced condition.

Figure 7:
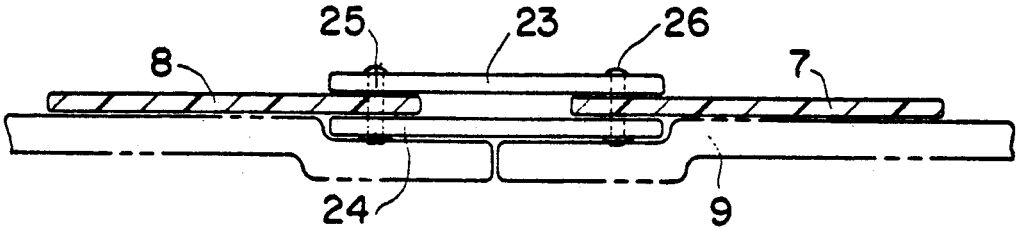
FIG. 7 is a fragmentary horizontal sectional view, on an enlarged scale, taken substantially along line 7—7 of FIG. 3.
Figure 8:
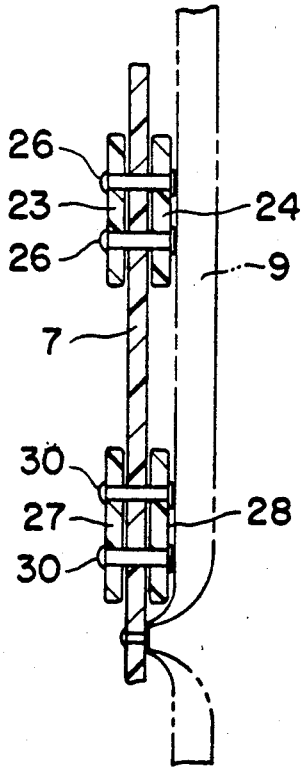
FIG. 8 is a fragmentary vertical sectional view, on an enlarged scale, taken substantially along line 8—8 of FIG. 3.

Referring to FIGS. 3, 7 and 8, in order to prevent the arch members 3 and 4 and associated breastplates 5, 6 and backplates 7, 8 from movement relative to each other in a vertical plane, a first pair of rigid plastic plates 23 and 24 extend between the backplate portions 7 and 8 and are riveted thereto as at 25 and 26, and a second pair of rigid plastic plates 27 and 28 are similarly riveted as at 29 and 30 to the backplate portions 7 and 8, to thereby hold the padded edges 9*a* of the backplate portions 7 and 8 in abutting relationship as shown in FIG. 3, and to hold the backplate portions 7 and 8 in rigid spaced relation.

Figure 4:
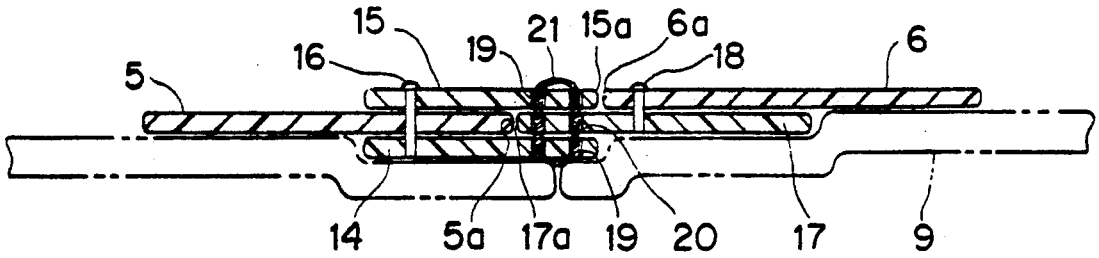
FIG. 4 is a fragmentary horizontal cross-sectional view, on an enlarged scale, taken substantially along line 4—4 of FIG. 1.
Figure 5:
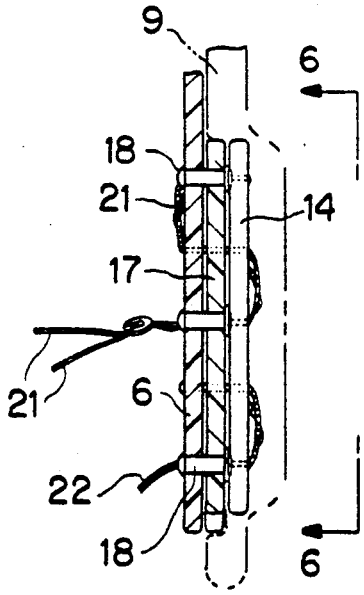
FIG. 5 is a vertical sectional view, on an enlarged scale, taken substantially along line 5—5 of FIG. 1.
Figure 6:
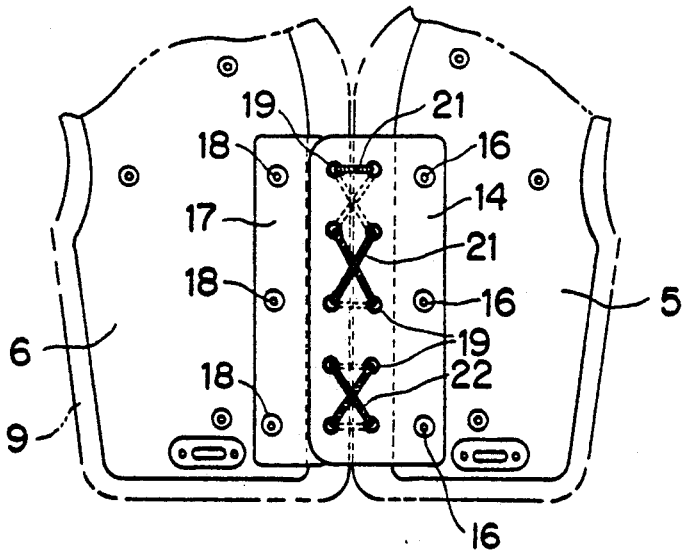
FIG. 6 is a fragmentary back elevational view taken substantially along line 6—6 of FIG. 5.

While the plurality of plates 23, 24, 27 and 28 hold the padded edges of the backplate portions in abutting relationship, and the backplate portions vertically immovable relative to each other, the plates 15 and 17 in the front-lock stabilizer are dimensioned, as will be seen in FIGS. 1 and 4, so that breastplate member 6 is substantially coplanar with the plate 15 so that their vertical edges 6*a* and 15*a* are adapted to be in abutting relationship. Similarly, breastplate member 5 is substantially coplanar with plate 17 so that their vertical edges 5*a* and 17*a* are adapted to be in abutting relationship when the laces 21 and 22 are tightened.

From the above description it will be appreciated by those skilled in the art that the laced interleaved plates 14, 15 and 17 closing the breastplates 5 and 6 provide a front lock to prevent the chest plates 5 and 6 from being deflected inwardly against the player's sternum as a result of a blow thereto. Furthermore, the abutting relationship of the breastplate edges 5*a*, 6*a* with the plate edges 17*a* and 15*a*, respectively, together with the rigid connection of the backplates 7 and 8 by the plates 23, 24, 27, 28 prevents the left shoulder pad and right shoulder pad from moving relative to each other in a vertical plane when either shoulder is hit, whereby the full impact of a hit to a particular shoulder prevents injury to the shoulder since the force of the hit is transmitted from one shoulder pad to the other shoulder pad.

To remove the shoulder pads, the laces 21 and 22 are loosened and removed to enable the breastplates 5 and 6 to be spread apart for removal over the head of the user.

The terms and expression which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

We claim:

1. A front-lock stabilizer for protective shoulder pads comprising, a pair of inverted arch members, each arch member having a first integral depending leg portion providing a breastplate and a second integral depending leg portion providing a backplate, the breasplate on one arch member having an opposed edge with the breastplate on the other arch member, a closure for connecting the breastplate on one arch member with the breastplate on the other arch member, said closure comprising a pair of spaced, horizontally disposed rigid plates and a single horizontally disposed rigid plate, means for fastening the pair of horizontally disposed plates on the edge of one breastplate, means for fastening the single horizontally disposed plate on the opposed edge of the other breastplate, said single plate being positioned in the space between the pair of plates, whereby all three plates lie in overlapping relationship, and means for fastening said plates in overlapping relationship to thereby prevent the breastplates from being deflected inwardly relative to each other as a result of a blow to the sternum of a wearer of the pads.

2. A front-lock stabilizer according to claim 1, wherein the backplate on one arch member has an opposed edge with the backplate on the other arch member, a plurality of plate members extending between said backplates, and fastening means securing each individual plate member to both of the backplates, thereby connecting the two backplates, whereby the opposed edges of the backplates are rigidly held from vertical relative movement.

3. A front-lock stabilizer according to claim 2, wherein the horizontally disposed plates have vertical edge portions, one of the plates of said pair of spaced plates and the single plate being dimensioned so that their vertical edge portions abut corresponding opposed edges on the breastplates, whereby the shoulder pads are locked from movement relative to each other in a vertical plane.

4. A front-lock stabilizer according to claim 1, in which one of the pair of spaced plates is fastened by said means in overlapping relationship to the front of said one breastplate, and the other of said pair of spaced plates is fastened in overlapping relationship to the back of said one breastplate.

5. A front-lock stabilizer according to claim 1, wherein the means for fastening the plates to the breastplates comprises, a plurality of rivets extending through said plates and said breastplates.

6. A front-lock stabilizer according to claim 1, wherein the means for fastening said plates in overlapping relationship comprises a plurality of holes in each of said plates, said holes being aligned with the holes in the adjacent plates, and laces threaded through the holes.

7. A front-lock stabilizer according to claim 4, in which the plate of said pair of spaced plates that is fastened to the front of said one breastplate is substantially coplanar with said other breastplate.

8. A front-lock stabilizer according to claim 7, in which said single plate is fastened in overlapping relationship with the back vertical edge portion of said other breastplate and is substantially coplanar with said one breastplate.

9. A front-lock stabilizer according to claim 1, in which one of the plates of said pair of spaced plates fastened to said one breastplate is coplanar with said other breastplate.

10. A front-lock stabilizer according to claim 1, in which said single plate fastened to said other breastplate is coplanar with said one breastplate.

* * * * *